United States Patent [19]

van Mullekom

[11] Patent Number: 4,503,889

[45] Date of Patent: Mar. 12, 1985

[54] SHUTTLELESS WEAVING MACHINE COMPRISING MEANS FOR REMOVING DEFECTED WEFT THREADS FROM THE WEAVING SHED

[75] Inventor: Hubert P. van Mullekom, Deurne, Netherlands

[73] Assignee: Ruti-te Strake B.V., Netherlands

[21] Appl. No.: 496,403

[22] Filed: May 20, 1983

[30] Foreign Application Priority Data

Jun. 1, 1982 [NL] Netherlands ..... 8202215

[51] Int. Cl.[3] ..... D03J 1/00; D03J 3/00; D03D 51/34

[52] U.S. Cl. ..... 139/1 R; 139/370.2; 139/380

[58] Field of Search ..... 139/1 R, 348, 370.1, 139/370.2, 380, 291 R, 291 C, 302

[56] References Cited

U.S. PATENT DOCUMENTS

| | | | |
|---|---|---|---|
| 378,376 | 2/1888 | Rooney | 139/380 |
| 4,185,667 | 1/1980 | Kendrick | 139/302 |
| 4,361,171 | 11/1982 | Fukuda | 139/348 |
| 4,398,568 | 8/1983 | Rydborn | 139/1 R |

*Primary Examiner*—James Kee Chi

*Attorney, Agent, or Firm*—Burns, Doane, Swecker & Mathis

[57] ABSTRACT

The weaving machine has a device which is movable in the weft direction and comprises a loosening element adapted to be moved transverse to the weft direction and a catching element movable perpendicular to the cloth plane. Thereby also weft portions may be removed which have already been cut off from the yarn supply as well as broken weft portions.

1 Claim, 6 Drawing Figures

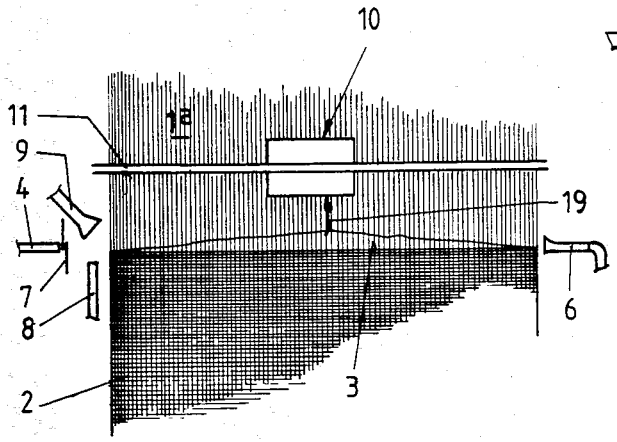
FIG. 2
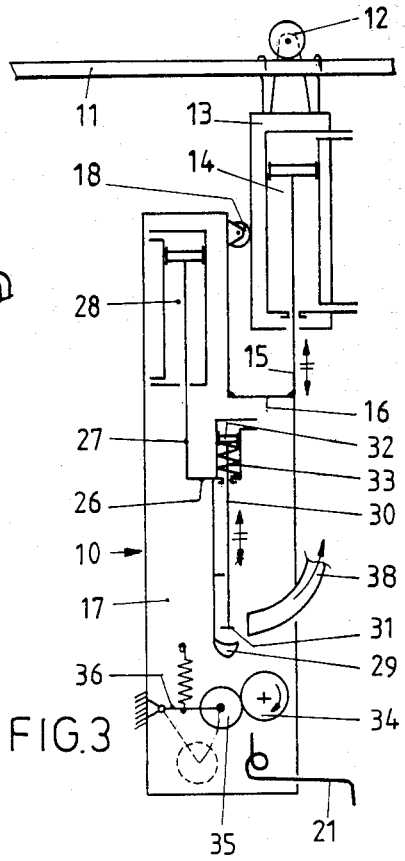
FIG.3
FIG.4A
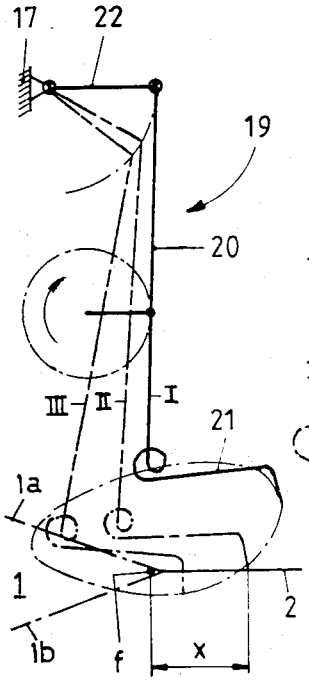
FIG.4B
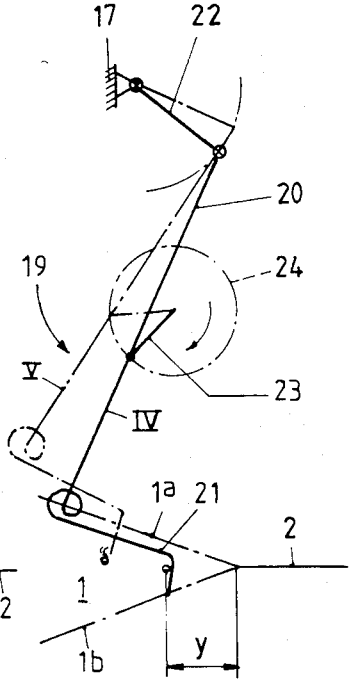
FIG.5
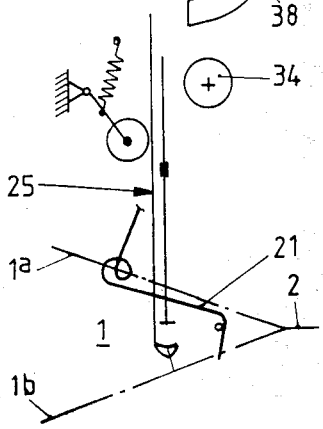

SHUTTLELESS WEAVING MACHINE COMPRISING MEANS FOR REMOVING DEFECTED WEFT THREADS FROM THE WEAVING SHED

The invention relates to a shuttleless weaving machine comprising a detector for tracing defects on weft threads and means for removing defected weft threads from the weaving shed, the detector cooperating such with the driving apparatus of the weaving machine that the main machine shaft is turned backwardly through an angle at a defect signal of the detector and thereby the latest weaving shed change is cancelled in order to undo the binding between the warp threads and the defected weft thread.

Such a weaving machine is known, e.g. from the Dutch Pat. No. 146.551.

The means whereby the defected weft thread—after the binding with the warp threads has been undone by turning backwardly the main machine shaft—is removed from the weaving shed are thereby constituted by blowing nozzles positioned between the ends of the weaving shed and serving during normal operation of the machine for the thread transport through the weaving shed and are supplied with transport air. Therewith it is essential that the defected weft thread length remains connected with the weft yarn supply. Therewith it is assumed that when launching the next weft the defected weft thread is gradually pulled away from between the warp threads meeting at the beating up line, starting with the launching side of the weaving shed and is discharged in the weft direction through the weaving shed.

The invention aims at improving said machine. Therefore with the machine according to the invention the means for removing a defected weft thread from the weaving shed are constituted by a device positioned outside the weaving shed and movable, when the machine is at stand still, in the weft direction along the beating up line of the cloth, said device having a loosening element which is movable in a plane transverse to the weft direction and therewith brushing the cloth at the position of the beating up line in the reed retracting direction, as well as a catching element movable from a position outside the weaving shed between the warp threads to a position within the weaving shed at a distance from the beating up line, said catching element being adapted to catch the loosened weft thread and pull it outwardly in the shape of a loop between two warp threads, a discharge suction mouth being provided adjacent to the position of the catching element outside the weaving shed.

The advantage of the machine according to the invention is that it is not necessary for effectively removing defected weft threads that they remain for the time being connected with the weft yarn supply still to be used. Moreover, it is prevented that, when a weft thread breaks, portions of the defected weft thread would remain adjacent to the beating up line between the warp threads.

The invention is hereunder further explained with reference to the drawing of an embodiment given as example.

FIG. 2 shows a schematic plan view of a shuttleless weaving machine with the device for correcting weaving errors according to the invention;

FIG. 3 shows a simplified elevation of the device for correcting weaving errors according to the invention;

FIGS. 4A and 4B show the loosening element of the device for correcting weaving errors according to the invention in a plurality of successive positions and FIG. 5 shows schematically the loosening element and the catching element at a moment just before the defected weft thread loosened from the cloth by the loosening element is catched by the catching element.

Figure 1:
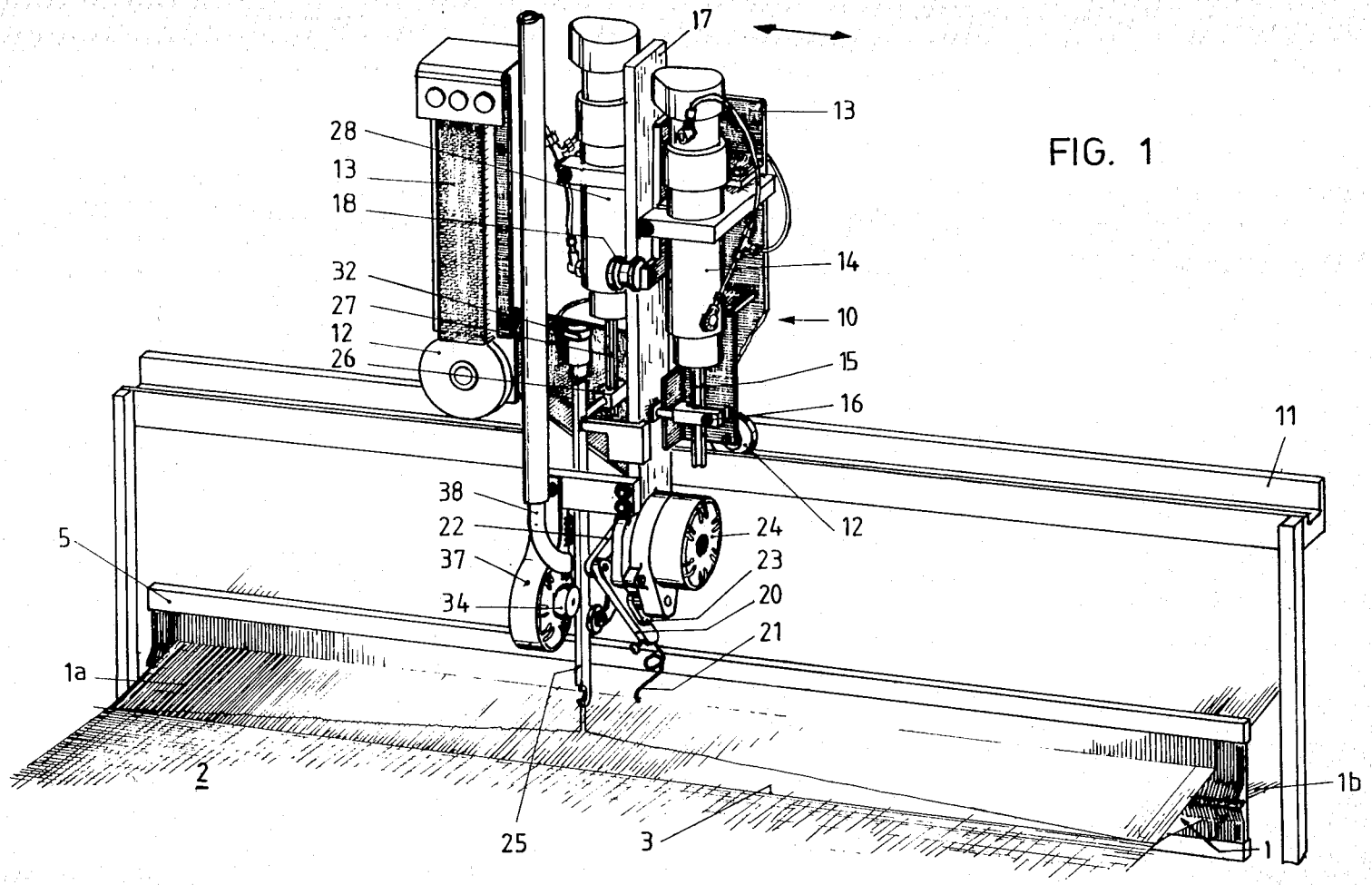
FIG. 1 is a perspective view of the device for correcting weaving errors according to the invention.

In the drawing reference number 1 indicates the weaving shed delimited by the upper and lower warp threads 1*a* and 1*b*, while reference number 2 indicates the cloth and reference number 3 indicates the beating up line.

The weft inserting device is represented in FIG. 2 by the main blowing nozzle 4 positioned at the left end—the launching side—of the weaving shed. Said main blowing nozzle is carried by the laybeam or reed-baulk reciprocatingly movable in the warp direction and not further shown in the drawing.

The reed has been indicated in FIG. 1 by the reference number 5.

At the other end—the receiving side—of the weaving shed 1 the usual suction mouth 6 is provided whereby a.o. the weft thread ends which are cut off at the right side of the cloth are sucked off.

Further at the launching side of the weaving shed a cutting means 7 is provided which like the main blowing nozzle 4 is carried by the lay beam, by means of which during normal operation a weft thread which has been inserted into the weaving shed and has been beaten up into the cloth by the reed 5, is cut from the weft yarn supply. Along the cloth edge at the launching side of the weaving shed an auxiliary blowing nozzle 8 has been provided with its blowing direction directed transverse to the insert direction, said nozzle cooperating with an auxiliary suction mouth 9. The purpose of said auxiliary blowing nozzle is further described below.

Between the right hand cloth edge and the stationary mounted suction mouth 6 at the receiving side of the weaving shed there is further provided a device, not further shown in the drawing, for detecting the weft threads which are successively launched by the inserting device.

So far the described weaving machine satisfies the prior art. In accordance with the operation of the correcting device for weaving errors as described in the above mentioned patent, in a weaving machine according to the invention the following operations take place during the first phase of the process for correcting weaving errors:

As soon as the weft detection device observes a weaving error the main driving apparatus of the machine is disconnected and the movements of the reciprocating reed and the weaving shafts not further shown in the drawing are braked. Simultaneously the drive of the weft preparation device is disconnected.

Due to the relatively large mass of the said reciprocating parts it cannot be avoided that the reed and the weaving shafts will complete their reed beating up movement and weaving shed change movement respectively, which have been started already at the moment of the weaving error detection, before they come to a stand still. This means that the defected weft thread has already been bound into the cloth at the moment in which the machine has arrived at stand still and the process for correcting the weaving error can start. Therefore the control of said process for correcting weaving errors is, according to the control in the weaving machine according to the above mentioned patent, adapted such that as the first step of the process for correcting the weaving error the main machine shaft is rotated backwardly through an angle of e.g. 360°, whereby the lastly carried out weaving shed change is "made undone" and the defected weft thread is made free. Then the reed and the weaving shaft have returned to the position which they took at the moment in which the defected weft thread was launched.

For the further course of the process for correcting weaving errors the invention now uses different means for removing the defected weft thread from the weaving shed. Particularly according to the invention a device is used for removing defected weft threads, which is adapted to remove defected weft threads which not only have already been beaten up into the cloth but also already have been cut loose from the weft yarn supply.

The device for correcting weaving errors as proposed according to the invention is indicated in the drawing by the reference number 10 and is carried by a rail 11 provided over the weaving shed and extending parallel to the insert direction. The device 10 may ride along the rail 11 by means of wheels 12 mounted on a main frame 13 of the device. Of the wheels 12 as shown in FIG. 1 e.g. the left wheel is driven by a motor which may be automatically energized during the process for correcting the weaving error or may be switched on by hand. Said motor is not further shown in the drawing. The main frame 13 carries a piston-cylinder device 14 which may be supplied e.g. by pressurized air, the piston rod 15 of which, which extends downwardly beyond the cylinder, is connected through a cross-connection piece 16 to an auxiliary frame 17 which is guided in vertical direction relative to the main frame 13 by a plurality of guided rollers 18, provided on the main frame 13.

It will be clear that by supplying pressurized air to the cylinder space over and under the piston respectively, the auxiliary frame may be displaced in the downward or upward direction respectively, relative to the main frame 13.

A loosening element 19 has been provided to the lower end of the auxiliary frame 17, said element mainly comprising a rod 20 provided at its free lower end with a resilient tooth or finger 21. The upper end of the rod 20 is connected to the auxiliary frame 17 through a rocker lever 22 while a crank arm 23 is in engagement with an intermediate point on the rod 20, said arm being driveable in the direction of the arrow (see FIGS. 4A, B) by a drive motor 24 likewise mounted on the auxiliary frame 17.

The hinge- or rotational axes respectively of the rocker lever 22 and the crank arm 23 extend parallel to the weft direction. The lengths and the mutual positions of the rocker lever 22 and the crank arm 23, as well as the dimensions of the rod 20 and the finger 21, are further selected such that the free end of the resilient finger 21 moves, when the crank arm 23 rotates, through a closed path of movement in the shape of a relatively flat ellipse. In the upper position of the auxiliary frame 17 said path of movement is situated completely above the planes delimiting the woven cloth 2 and the upper warp threads. In the lower position of the auxiliary frame 17 on the other hand the planes delimiting the woven cloth and the weaving shed are intersected by said path of movement as is shown in FIGS. 4A, B and FIG. 5.

In FIG. 4A three successive positions I, II and III of the loosening element 19 relative to the weaving shed 1 and the woven cloth 2 are shown. In position II the free end of the resilient finger 21 has arrived at the cloth 2. It is clear that in the movement from position II to position III the free finger end would tend to move in the downward direction through the plane delimiting the woven cloth 2. However, the cloth 2 does not permit such a movement and imparts during the movement under consideration, from position II to position III, an upwardly directed force to the free finger end whereby said finger end is pressed upwardly against the spring force of the finger 21 and brushes along the cloth under a certain bias until the distance x to the beating up line 3 has been bridged. As soon as it arrives at the beating up line there is no longer a woven cloth which may arrest the resilient finger 21 so that the free finger end 21 will immediately resiliently move downwardly between the warp threads and thereby engage behind the defected weft thread f. FIG. 4B shows the loosening element 19 in a position IV in which the defected weft thread f has been taken along through a distance y to the left relative to the beating up line 3 and thereby has come free from the upper and lower warp threads 1*a* and 1*b*. FIG. 4B further shows a fifth position V in which the resilient finger 21 is about to release the defected weft thread f and to leave the weaving shed through the upper warp threads 1*a*.

It will be clear that with the device for correcting weaving errors as described so far a defected weft thread, which has been made accessible, by turning backwardly the reed and the shaft threads, for being removed, may be released from its beating up position along the beating up line in a simple and effective manner, by moving the device 10 from the one end to the other end of the weaving shed and by having simultaneously carry out the loosening element its operation as just described. It is preferable therewith to have the movement of the device 10 along the rail 11 take place in steps, under the understanding that after every movement step the loosening element 19 is temporarily retracted into its inoperative position and is again repositioned in its operative position after a next movement step of the device 10 has been carried out. Preferably one has the device 10 start its movement at the receiving side of the weaving shed. Therefore the end position at the receiving side of the weaving shed is considered to be the starting position of the device 10. For it is that if the cause of the observed weaving error is contained in a rupturing of the weft thread, the downstream portion of the weft thread, the head end of which is already in the operative area of the suction mouth 6 at the receiving side of the weaving shed, will be automatically discharged by said suction mouth from the weaving shed, as soon as the device 10 moving from the receiving side in the direction of the launching side, has arrived at the position of the thread interruption. For it is that at that moment the weft thread portion, which has been broken off, has become situated in the weaving shed completely free and offers no longer a resistance to the sucking action of the suction mouth. When the device 10 moves further to the left, to the launching side of the weaving shed, also the remainder of the defected weft thread is released from the beating up position along the beating up line. However, it will be clear that for removing the thus freed weft thread portion the suction mouth 6 cannot be used in view of the circumstance that the head end of said thread portion will generally be outside the influencing area of the suction mouth 6. The same applies to removing a released defected weft thread from the weaving shed when the defect is caused by the occurrence of a loop or knot. In such a case a weaving error is observed thereby that the head end of the thread has not arrived at the detection device (on time) and thereby likewise remains outside the influence area of the suction mouth 6.

The device according to the invention further comprises provisions whereby defected weft threads or thread portions respectively, which are not operated upon by the suction mouth 6 yet may be discharged in a sure and effective manner. Said further provisions comprise a substantially needle-shaped catching element 25 which may be entered with its operative lower end from a position outside and above the weaving shed 1 between two adjacent upper warp threads 1*a* into a position within the weaving shed 1. The needle-shaped catching element 25 thereto is connected through a cross-piece 26 to the projecting piston rod end 27 of a second piston-cylinder device 28. Said piston-cylinder device is mounted on the auxiliary frame 17 and is e.g. likewise supplied with pressurized air. Normally the catching element 25 is in an inoperative position corresponding to the upper position of the piston in the piston-cylinder device 28 and this without regard to the position of the auxiliary frame 17 relative to the main frame 13. The catching element 25 has a lateral recess at its operative lower end facing the beating up line whereby a supporting surface 29 for the weft thread to be removed is obtained.

The catching needle 25 is provided with a central cavity in which a rod 30 is guided up and down movable, said rod having at its lower end a clamping surface 31 which is adapted to cooperate with the supporting surface 29 in order to clamp a catched weft thread to the supporting surface 29. In order not to jeopardize the clarity of FIG. 1 the rod 30 with the clamping surface 31 has not been shown in FIG. 1, but only in the schematic picture according to FIG. 3. The rod 30 is secured with its upper end to a piston 32 movable upwardly and downwardly in a relatively small cylinder and normally assumes an upper inoperative position under the influence of a spring 33 provided around the rod 30 below the piston 32. The rod 30 and thereby the clamping surface 31 may be positioned against the influence of the spring 33 in an operative clamping position relative to the supporting surface 29, e.g. by supplying over the piston 32 a pressurized fluid, e.g. pressurized air.

Further at the lower end of the auxiliary frame 17, namely adjacent to the path of movement of the catching needle 25, a driven roller 34 as well as a counter-pressure roller 35 cooperating therewith are mounted to the free end of a lever 36 being under the influence of the spring, the purpose of said rollers being explained below.

The above described catching element 25 preferably operates as follows:

As soon as the device 10 has arrived during its movement from the receiving side to the launching side at short distance of the cloth edge at the launching side, pressurized air is supplied to the space over the piston in the piston-cylinder device 28, whereby the piston rod 27 together with the catching needle 25 are moved downwardly from the inoperative to the operative position. During said movement the counter-pressure roller 35, positioned in the path of the catching needle 25, is pushed downwardly against the action of the spring while the roller 34 remains just free from the catching needle 25 or starts rotating respectively. At the end of the downward stroke of movement the catching needle with the supporting surface 29 comes to a stand still in the position within the weaving shed as shown in FIG. 5. At that moment the rod 30 with the clamping surface 31 is still in the inoperative upper position. Shortly afterwards the defected weft thread f will be entered by the resilient finger 21 of the loosening element 19 spaced at some distance upstream from the catching needle 25, which finger rotates in the manner as has been described already, into the lateral recess at the lower end of the catching needle 25. Shortly afterwards the rod 30 is moved downwardly by supplying pressurized fluid over the piston 32 whereby the catched weft thread is clamped by the clamping surface 31 to the supporting surface 29. Almost simultaneously the catching needle 25 is retracted in the upward direction by supplying pressurized air to the space below the piston in the cylinder 28. Thereby the catched weft thread is taken along in the shape of a loop between two adjacent warp threads. After the passing of the catching needle 25 the counter-pressure roller 35 returns to its operative position relative to the roller 34 driven by the motor 37 whereby the thread loop is clamped between said both rollers. As soon as the catching needle 25 has arrived in its upper inoperative position the energization of the piston 32 is removed and the clamping surface 31 is released from the supporting surface 29 which in that position is immediately adjacent to a suction mouth 38 carried by the auxiliary frame 17. The top of the loop is thereby sucked from the supporting surface 29 into the suction mouth 38 while the loop legs are pulled by the two cooperating rotating rollers 34 and 35 in positive manner between the said warp threads from the weaving shed and are presented for discharging to the suction mouth 38.

After the defected weft thread f has thus been removed and discharged the device then returns to its starting position at the receiving side of the weaving shed.

The operations as described above of course all may be carried out as steps of an automatic control process. It does not seem necessary for a good understanding of the invention to explain such a control process in detail.

Restarting the normal weaving operation could be obtained e.g. in similar manner as described in the above mentioned patent.

As has been remarked above the device according to the invention is particularly adapted to removing defected weft threads in cases in which it cannot be avoided that the defected weft thread is already cut from the weft yarn supply before the detection device has been able to trace a weaving error. This would apply particularly to weaving machines operating at a relatively high number of rpm. In the modern weaving machines the rpm's of the main shaft are so high that the launching of the next weft thread may already have taken place at the moment in which the machine has arrived at standstill after a weaving error has been observed.

In connection with said last mentioned circumstance the auxiliary blowing nozzle 8, as already described above, has been applied which, when a weaving error is traced, is immediately supplied with pressurized air so that the weft thread which yet has been launched during the braking phase does not arrive in the weaving shed, but is bent laterally in the direction of the auxiliary suction mouth 9 and—after cutting—is discharged.

I claim:

1. Shuttleless weaving machine comprising a detector for tracing defects on weft threads and means for removing defected weft threads from the weaving shed, the detector cooperating such with the driving apparatus of the weaving machine that the main machine shaft is rotated backwardly through an angle at a defect signal of the detector and thereby the latest weaving shed change is made undone in order to cancel the binding between the warp threads and the defected weft thread, characterized in that the means for removing a defected weft thread from the weaving shed are constituted by a device positioned outside the weaving shed and movable, when the machine is at stand still, in the weft direction along the beating up line of the cloth, said device having a loosening element movable in a plane transverse to the weft direction and therewith brushing the cloth at the position of the beating up line in the retracting direction of the reed, as well as a catching element movable from a position outside the weaving shed between the warp threads to a position inside the weaving shed at a distance from the beating up line, said catching element being adapted to catch the loosened weft thread and to pull it outwardly in the shape of a loop between two warp threads, a discharge-suction mouth being provided adjacent to the position of the catching element outside the weaving shed.

* * * * *